US005220758A

United States Patent [19]

Stommel

[11] Patent Number: 5,220,758

[45] Date of Patent: Jun. 22, 1993

[54] COVERING FOR BUILDING FACADES ETC.

[75] Inventor: Lothar Stommel, Gelsenkirchen-Resse, Fed. Rep. of Germany

[73] Assignee: Lothar Stommel Fassadenbau GmbH, Gelsenkirchen-Resse, Fed. Rep. of Germany

[21] Appl. No.: 900,191

[22] Filed: Jun. 17, 1992

[30] Foreign Application Priority Data

Jun. 27, 1991 [DE] Fed. Rep. of Germany ... 9107888[U]

[51] Int. Cl.[5] ..... E04B 2/88

[52] U.S. Cl. ..... 52/235; 52/779

[58] Field of Search ..... 52/235, 777, 778, 779, 52/780, 285, 479–481, 509, 513

[56] References Cited

U.S. PATENT DOCUMENTS

| | | | |
|---|---|---|---|
| 2,822,584 | 2/1958 | Urbain | 52/779 |
| 3,412,515 | 11/1968 | Finon | 52/480 |
| 3,488,908 | 1/1970 | Jahn | 52/779 |
| 3,561,182 | 2/1971 | Madl, Jr. | 52/779 |
| 3,672,107 | 6/1972 | Santry et al. | 52/779 |
| 4,741,136 | 5/1988 | Thompson | 52/285 |
| 5,083,405 | 1/1992 | Miller | 52/235 |

FOREIGN PATENT DOCUMENTS

| | | |
|---|---|---|
| 352973 | 4/1975 | Austria . |
| 2749421 | 11/1977 | Fed. Rep. of Germany . |
| 3702124 | 1/1987 | Fed. Rep. of Germany . |

*Primary Examiner*—David A. Scherbel
*Assistant Examiner*—Michele A. Van Patten
*Attorney, Agent, or Firm*—Robert W. Becker & Associates

[57] ABSTRACT

In a building facade covering comprised of a profiled rail support frame and covering panels connected thereto, the vertically extending profiled rails have brackets onto which the respective covering panel with an edge surface recessed behind the panel front face is placeable. Each profiled rail has two vertically extending hollow boxes in which inserted holding elements are horizontally slidable parallel to the covering panel plane and which protrude with a hook-shaped end. The neighboring vertical side edges of two respective covering panels are connected to a common profiled rail in such a manner that the hook-shaped ends of the holding elements are inserted into the receiving pockets of the covering panels by horizontally sliding them within the hollow boxes, the receiving pockets being arranged at vertical side edges of the covering panels at edge surfaces recessed behind the panel front face.

9 Claims, 3 Drawing Sheets

COVERING FOR BUILDING FACADES ETC.

BACKGROUND OF THE INVENTION

The invention concerns a covering for building facades etc., comprised of a preassembled support frame connected to the building facade and essentially rectangular covering panels connected in a detachable manner to the support frame, whereby the support frame contains vertically extending profiled rails for supporting and attaching thereto the edges of the covering panels.

Facade coverings with covering panels made of mineral materials such as, for example, marble are common in which the covering panels in principle are connected to the building facade in an invisible manner whereby bolts or similar anchors are connected to recesses of the covering panel backside on the one hand and, on the other hand, to the building facade, for example, by cementing. This is especially disadvantageous because a later removal of the covering panels is only possible by destroying the covering panels. With other commonly used facade coverings a later releasable attachment of the covering panels to a preassembled support frame, for example, made of profiled rails of aluminum is employed; however, this known covering construction has the disadvantage that elements of the releasable panel attachment are visible at the front face of the covering panels or at least within the seams between the covering panel edges so that the visual appearance of the facade covering is impaired.

It is an object of the present invention to provide a covering for building facades or, for example, also for interior building walls in which the covering panels are attached in an invisible as well as releasable and removable manner to the building facade.

SUMMARY OF THE INVENTION

The covering for building facades according to the present invention is primarily characterized by:

Essentially rectangular covering panels that are vertically positioned, having a front face and a lower edge surface which is recessed relative the front face and having two lateral edges with at least one portion that has an edge surface recessed relative to the front face, the edge surface having a recessed receiving pocket;

A preassembled support frame connected to the building facade, with the covering panels connected to the support frame, the support frame comprising vertically extending profiled rails for supporting and fastening the covering panels, with two neighboring ones of the lateral edges of two adjacent ones of the covering panels fastened to a common one of the profiled rails;

The support frame having a bracket for each covering panel for receiving the weight of covering panel being placed with the lower edge surface into the bracket;

The profiled rails having two hollow boxes spaced from one another and positioned behind the lateral edges of the adjacent panels, each hollow box having an opening at a face that is facing the other hollow box;

Each hollow box comprising a holding element inserted into the hollow box, the holding element having a hook-shaped portion extending past the opening, the holding element being horizontally slidable parallel to the plane of the covering panels, with the opening of the hollow box, at a location above the receiving pocket, having a widened portion through which the holding element is inserted into the hollow box and lowered to the elevation of the receiving pocket, and with a free end of the hook-shaped portion being inserted into the receiving pocket by horizontally sliding the holding element within the hollow box parallel to the plane of the covering panels.

Preferably, the lower edge has a holding pocket and the bracket has an upwardly bent lower end engaging the holding pocket and holding the covering panel against the support frame.

In an advantageous embodiment, the width of the upwardly bent lower end corresponds essentially without play to the width of the holding pocket, and the width of the free end of the hook-shaped portion corresponds essentially without play to the width of the receiving pocket.

In a further embodiment of the present invention, a fastening member is provided that is placed on the hook-shaped portion of the holding element from the top, the fastening member securing itself against horizontal displacement at the profiled rail and blocking the holding element against horizontal displacement within the hollow box in the position in which the free end of the hook-shaped portion is inserted into the receiving pocket. The fastening member may secure itself directly or indirectly.

The covering for building facades preferably further comprises a U-shaped holding bracket for attaching the covering panels to a corner where a first and a second building facade meet. In this embodiment, the profiled rail on the first building facade has a receiving groove that opens in a direction toward the covering panels, the U-shaped holding bracket having a first leg that is inserted into the receiving groove and a second leg that is inserted into the receiving pocket of one of the covering panels arranged on the second building facade along a longitudinal side of the profiled rail. Preferably, the profiled rail has a receiving groove on either longitudinal side.

BRIEF DESCRIPTION OF THE DRAWINGS

An embodiment and the function of the inventive covering will be described in the following with the aid of the drawing representing an exemplary embodiment. It is shown in.

DESCRIPTION OF PREFERRED EMBODIMENTS

Figure 1:
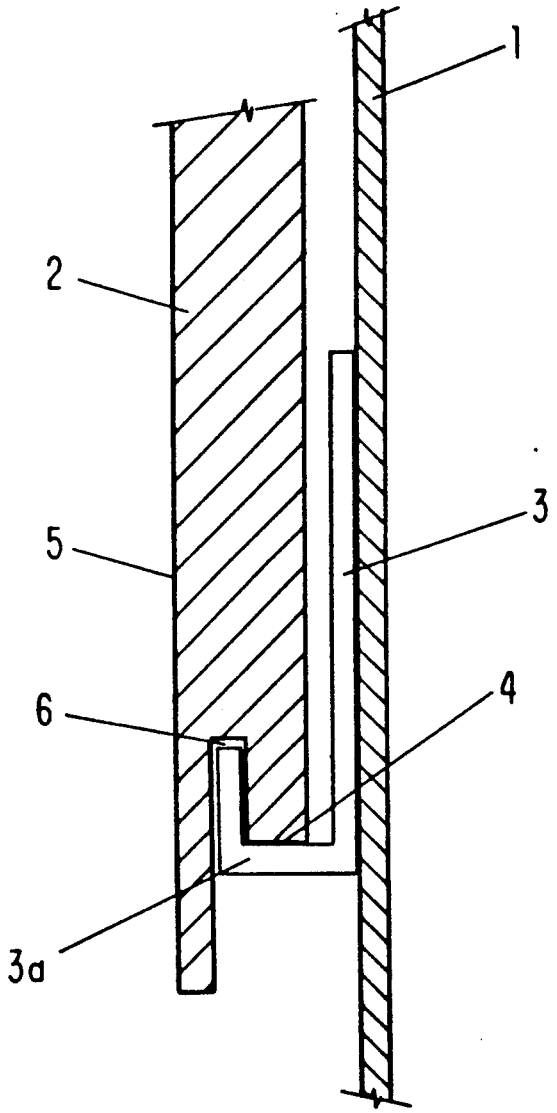
FIG. 1 vertical cross-section of a portion of a covering panel and the support frame.

The covering is comprised of the support frame indicated generally with reference numeral 1 in FIG. 1 and comprising at least vertically extending profiled rails 7, for example, made of aluminum, and covering panels 2 which are essentially rectangular and may be comprised of, for example, synthetically manufactured marble. The covering panels 2 have a thickness which, on the one hand, is sufficient to provide the required stiffness to the covering panels with respect to, for example, wind pressure and wind suction and, on the other hand is required for embodying the covering panels according to inventive measures.

The support frame 1 has at least one bracket 3, for receiving the weight of each covering panel 2. The covering panel 2 is placed on the bracket 3 with its lower edge surface 4. Of course, the bracket 3 may be positioned at the correct location of the support frame relative to the shape and the height of the covering panel with respective embodiments and measures that are not detailed further. The bracket 3 may be a simple support on which the covering panel rests for its weight distribution. The edge surface 4 is recessed, for example, by cutting the panel edge within the area of the bracket 3 behind the front face 5 of the covering panel 2 so that the bracket 3 is invisible at the front face 5 of the facade covering.

Figure 2:
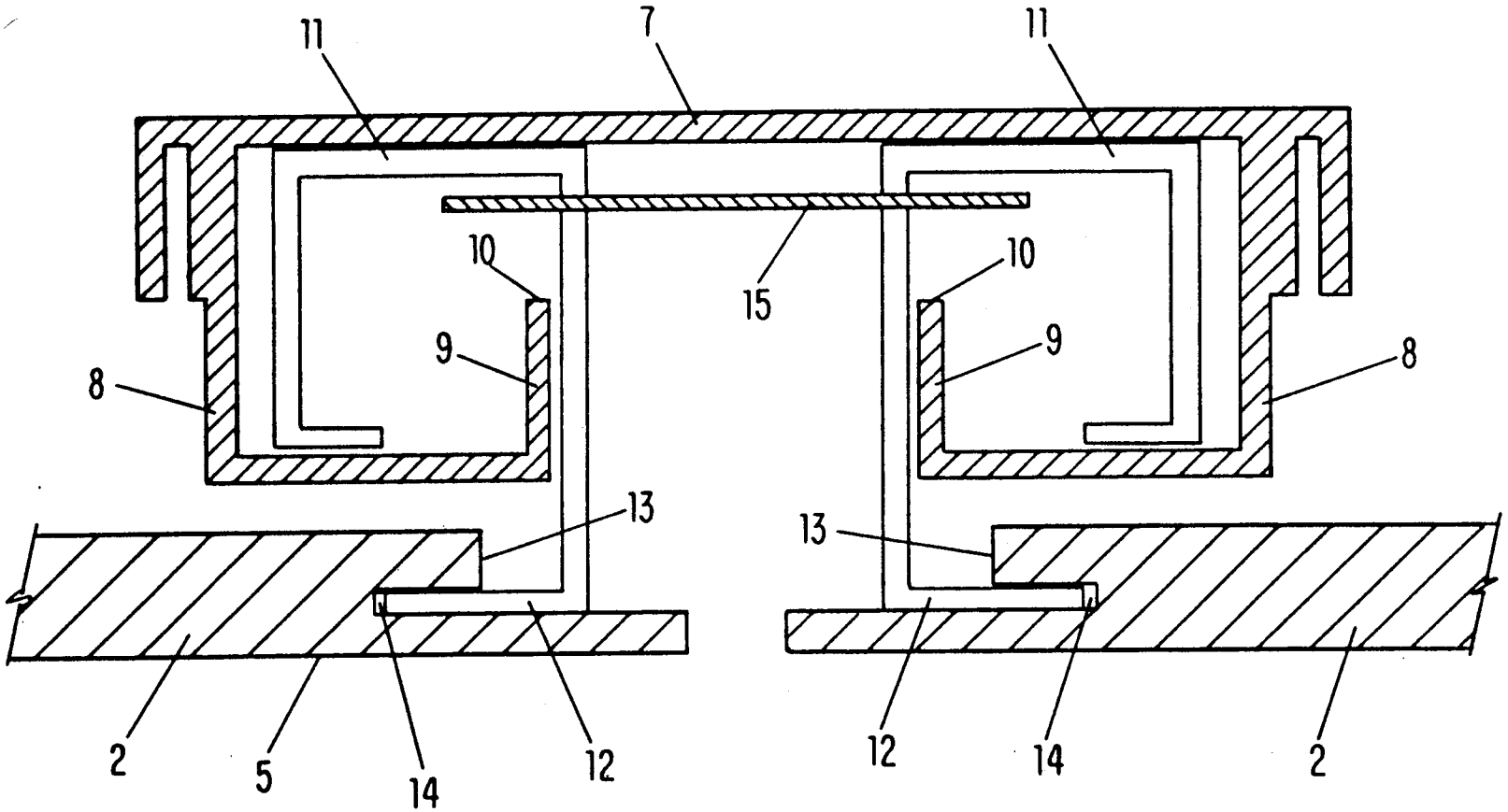
FIG. 2 a horizontal cross-section of the support frame and of two neighboring covering panels arranged in the same covering plane.

Advantageously, the covering panel 2 is furthermore provided with a slot-like cut-out holding pocket 6 at the rearwardly recessed lower edge surface 4 which is engaged from the bottom by the hook-shaped bracket 3 represented in FIG. 1 The bracket 3 not only bears the weight of the covering panel 2, but also holds the covering panel 2 with its lower end close to the support frame 1 so that, depending on the height of the covering panels 2, it may be sufficient to provide a further, invisible as well as detachable attachment only at the upper end of the covering panel, (see FIG. 2).

In order to invisibly and detachably attach the neighboring lateral edges of two covering panels 2, which are arranged in the same covering plane, at at least one location of their lateral edges to a common vertically extending profiled rail 7 of the support frame 1, the profiled rail 7 has two vertical hollow boxes 8. The hollow boxes 8, in cross-section, are preferably rectangular and arranged at a horizontal distance relative to one another behind the two neighboring lateral panel edges. The hollow boxes 8 are embodied with openings 10 at their sides 9 facing one another. A holding element 11 inserted into the hollow box 8 protrudes through this opening 10. The section of the holding element 11 which is positioned inside the hollow box 8 is formed such that the holding element 11 is restrained by the hollow box 8 against movement in a direction vertical to the covering plane (from the top to the bottom in FIG. 2). However, the holding element 11 may be moved to a limited extent in a horizontal direction parallel to the covering plane (from the left to the right in FIG. 2). The portion of the holding element 11 which extends from the hollow box 8 is provided with a hook-shaped portion 12. The covering panel 2, at the location of its lateral edge at which the connection via the holding element 11 shall be achieved, is provided with an edge surface 13, similar to the edge surface embodiment shown in FIG. 1, that is recessed relative to the front face 5 of the covering panel 2 and from which extends a cut-out receiving pocket 14. Into this receiving pocket 14 the hook-shaped portion 12 of the holding element is inserted by horizontally sliding the holding element 11 within the hollow box 8. In this position the holding element 11 is invisibly covered by the covering panel 2.

The width of the hook-shaped holding element portion 12 corresponds essentially to the width of the receiving pocket 14 so that the hook-shaped portion 12, in a direction vertical to the covering panel plane, engages essentially without play the receiving pocket 14. The same holds true for the bracket 3 represented in FIG. 1 when the bracket is not only designed to hold the weight of the panel, but also to fix the lower end of the covering panel 2 at a certain distance from the building facade.

In order to release one of the two panel attachments represented in FIG. 2, it is only necessary to introduce a hook-shaped tool through the commonly present slot between the two adjacent lateral panel edges and to move the holding element 11 within the hollow box 8 or to pull it outwardly until the hook-shaped portion 12 is released from the receiving pocket 14.

Above the receiving pocket 14 of the covering panel 2 the opening 10 of the hollow box 8 is widened to such an extent that the holding element at this location of the hollow box, respectively of the profiled rail 7, may be positioned between the two hollow boxes 8 and then inserted into the hollow box 8 via the widened portion: From this position the holding element 11 is then vertically lowered to the height of the receiving pocket 14 of the covering panel 2, whereby different suitable abutments at the profiled rail 7 or within the hollow box 8 may be provided which prevent a downward fall of the holding element 11 below the receiving pocket 14.

During the mounting of the facade covering, which takes places from the bottom to the top, a fastening member in the form of an arresting plate 15 provided with two slots extending from the lower edge may be placed onto the two holding elements 11 engaging the covering panels 2. The arresting plate 15 prevents an accidental displacement of both holding elements 11 from their engaging position with the covering panels 2. For a desired release of the covering panel attachment, the arresting plate 15 may be lifted off the two holding elements 11 by inserting a suitable tool into the slot between the two covering panel edges. Subsequently, the plate 15 may be returned to its position on the two holding elements.

Figure 3:
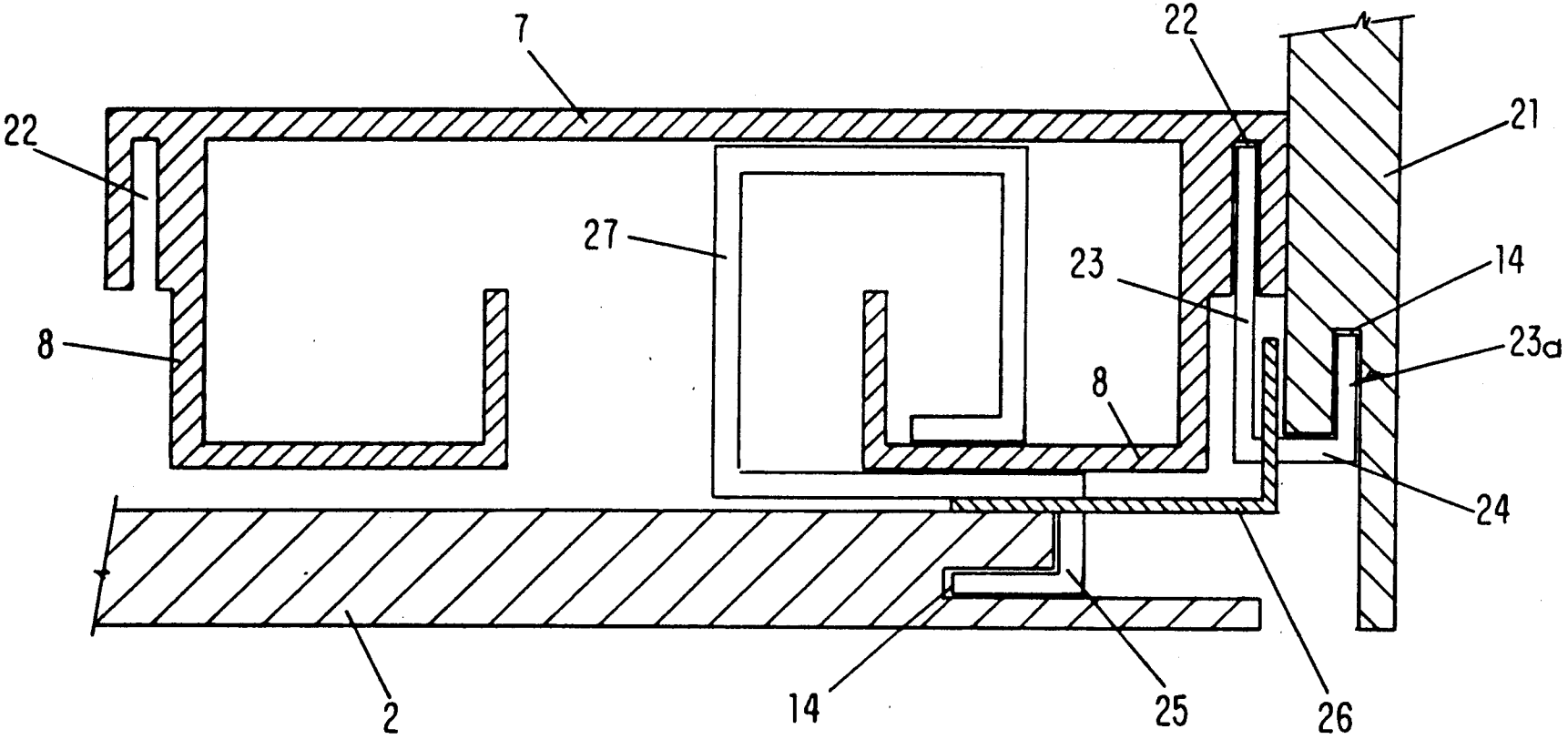
FIG. 3 a horizontal cross-section of the support frame and two covering panels which are positioned at a building corner between two covering planes arranged at a right angle relative to one another.

Represented in FIG. 3 is a releasable and invisible connection for two covering panels 2 and 21 which abut at the corner of a building. The profiled rail 7, which is connected to one of the building facades forming the building corner, is provided with a forwardly open receiving groove 22 at least at its longitudinal side facing the building corner, preferably at both longitudinal sides. A leg 23 of a U-shaped bracket 24 is inserted into this receiving groove 22. The other leg **23*a* of this bracket 24 engages the lateral receiving pocket 14 of the covering panel 21. The covering panel 2 which is arranged on the building facade holding the profiled rail 7 is arrested by the holding element 27 which is inserted into the hollow box 8 of the profiled rail 7 facing the building corner. For this purpose, the portion of the holding element 27 extending from the hollow box 8, in contrast to the holding element 11 in the right half of the FIG. 2, is not provided with a hook-shaped end but with a U-shaped end 25 in order to be able to engage the lateral receiving pocket 14 of the covering panel 2 in analogy to the embodiment shown in the left half of FIG. 2. For securing this holding element 27 and, simultaneously, the bracket 24 in the position holding the covering panels 2 and 21, a fastening member or arresting plate 26 may be employed having slots at its ends and being insertable onto the holding element 27 and the bracket 24. For its arresting, the bracket 24, may also be embodied such that only when the covering panel 2 is removed or laterally displaced it may be completely removed from the receiving pocket 14 of the covering panel 21**.

The present invention is, of course, in no way restricted to the specific disclosure of the specification and drawings, but also encompasses any modifications within the scope of the appended claims.

What I claim is:

1. A covering for a building facade, comprising:

essentially rectangular covering panels that are vertically positioned, having a front face and a lower edge surface which is recessed relative said front face and having two lateral edges with at least one portion that has an edge surface recessed relative to said front face, said edge surface having a recessed receiving pocket;

a preassembled support frame connected to the building facade, with said covering panels connected to said support frame, said support frame comprising vertically extending profiled rails for supporting and fastening said covering panels, with two neighboring ones of said lateral edges of two adjacent ones of said covering panels fastened to a common one of said profiled rails;

said support frame having a bracket for each said covering panel for receiving the weight of said covering panel being placed with said lower edge surface onto said bracket;

said profiled rails having two hollow boxes spaced from one another and positioned behind said lateral edges of said adjacent panels, each of hollow boxes having an opening at a face that is facing the other hollow box;

each hollow box comprising a holding element inserted into said hollow box, said holding element having a hook-shaped portion extending past said opening, said holding element being horizontally slidable parallel to the plane of said covering panels, with said opening of said hollow box, at a location above said receiving pocket, having a widened portion through which said holding element is inserted into said hollow box and lowered to the elevation of said receiving pocket, and with a free end of said hook-shaped portion being inserted into said receiving pocket by horizontally sliding said holding element within said hollow box parallel to the plane of said covering panels.

2. A covering for a building facade according to claim 1, wherein said lower edge surface has a holding pocket and said bracket has an upwardly bent lower end engaging said holding pocket and holding said covering panel against said support frame.

3. A covering for a building facade according to claim 2, wherein a width of said upwardly bent lower end corresponds essentially without play to a width of said holding pocket.

4. A covering for a building facades according to claim 1, wherein a width of said free end of said hook-shaped portion corresponds essentially without play to a width of said receiving pocket.

5. A covering for a building facade according to claim 1, further comprising a fastening member being placed on said hook-shaped portion of said holding element from the top, said fastening member securing itself against horizontal displacement at said profiled rail and blocking said holding element in the position in which said free end of said hook-shaped portion is inserted into said receiving pocket against horizontal displacement within said hollow box.

6. A covering for a building facade according to claim 5, wherein said fastening member secures itself directly.

7. A covering for a building facade according to claim 5, wherein said fastening member secures itself indirectly.

8. A covering for a building facade according to claim 1, further comprising a U-shaped holding bracket for attaching said covering panels to a corner where a first and a second building facade meet and wherein said profiled rail on the first building facade has a receiving groove that opens in a direction toward said covering panels, said U-shaped holding bracket having a first leg that is inserted into said receiving groove and a second leg that is inserted into said receiving pocket of one of said covering panels arranged on the second building facade along a longitudinal side of said profiled rail.

9. A covering for a building facade according to claim 8, wherein said profiled rail has one of said receiving grooves on either longitudinal side.

* * * * *